US011280210B2

(12) United States Patent
Albers

(10) Patent No.: US 11,280,210 B2
(45) Date of Patent: Mar. 22, 2022

(54) ROTOR FOR A TURBOMACHINE, AND TURBOMACHINE HAVING SUCH A ROTOR

(71) Applicant: MTU Aero Engines AG, Munich (DE)

(72) Inventor: Lothar Albers, Munich (DE)

(73) Assignee: MTU Aero Engines AG, Munich (DE)

( * ) Notice: Subject to any disclaimer, the term of this patent is extended or adjusted under 35 U.S.C. 154(b) by 87 days.

(21) Appl. No.: 16/449,849

(22) Filed: Jun. 24, 2019

(65) Prior Publication Data

US 2020/0011193 A1 Jan. 9, 2020

(30) Foreign Application Priority Data

Jun. 27, 2018 (DE) ..... 102018210513.8

(51) Int. Cl.
*F01D 11/00* (2006.01)
*F01D 11/12* (2006.01)
*F04D 29/08* (2006.01)

(52) U.S. Cl.
CPC ..... *F01D 11/122* (2013.01); *F01D 11/001* (2013.01); *F04D 29/083* (2013.01); *F05D 2220/323* (2013.01); *F05D 2240/55* (2013.01); *F05D 2300/611* (2013.01)

(58) Field of Classification Search
CPC ..... F01D 11/001; F01D 11/122; F04D 29/083
See application file for complete search history.

(56) References Cited

U.S. PATENT DOCUMENTS 5,215,435 A * 6/1993 Webb ..... F01D 5/08 277/414
5,984,314 A * 11/1999 Peters ..... F01D 11/02 277/417
7,025,565 B2 * 4/2006 Urso ..... F01D 11/02 415/173.5
9,243,511 B2 * 1/2016 Lee ..... F01D 25/24
(Continued)

FOREIGN PATENT DOCUMENTS

DE 102017204243 A1 9/2018
EP 3293360 A1 3/2018
(Continued)

OTHER PUBLICATIONS

He et al.:"Investigations of the conjugate heat transfer and windage effect in stepped labyrinth seals," International Journal of Heat and Mass Transfer 55 (2012) 4536-4547.
(Continued)

*Primary Examiner* — Michael L Sehn
(74) *Attorney, Agent, or Firm* — Davidson, Davidson & Kappel, LLC

(57) ABSTRACT

A rotor (10) for a turbomachine, in particular for an aircraft engine, having a rotor base body (12), on which at least one sealing fin (14), which is disposed on a base (16), is provided for cooperating with an associated sealing element (20) of the turbomachine; relative to an axial direction of the rotor (10), the base (16) having a base portion (16*a*) disposed upstream of the sealing fin (14) and a base portion (16*b*) disposed downstream thereof, for supporting masks during
(Continued)

the coating of sealing fins; the upstream base portion (16*a*) and the downstream base portion (16*b*) having different radial distances (A1, A2) to a radially outer sealing tip (18) of the sealing fin (14). Also, a turbomachine having at least one such rotor (10).

18 Claims, 4 Drawing Sheets

(56) References Cited

U.S. PATENT DOCUMENTS

| | | | |
|---|---|---|---|
| 9,388,701 | B2 | 7/2016 | Kuwamura et al. |
| 2003/0194322 | A1 | 10/2003 | Brandl |
| 2005/0150234 | A1 | 7/2005 | Urso et al. |
| 2008/0124215 | A1 | 5/2008 | Paolillo et al. |
| 2008/0260523 | A1 | 10/2008 | Alvanos et al. |
| 2009/0067997 | A1 | 3/2009 | Wu et al. |
| 2014/0105725 | A1* | 4/2014 | Stiehler ..... F01D 5/08 415/115 |
| 2016/0237855 | A1* | 8/2016 | Humhauser ..... F01D 11/001 |
| 2017/0370238 | A1* | 12/2017 | Geppert ..... F01D 5/34 |
| 2018/0112548 | A1 | 4/2018 | Albers et al. |
| 2018/0371927 | A1 | 12/2018 | Kuwamura et al. |

FOREIGN PATENT DOCUMENTS

| | | | |
|---|---|---|---|
| EP | 3312388 | A1 | 4/2018 |
| WO | WO2011122092 | A1 | 10/2011 |
| WO | WO2017098932 | A1 | 6/2017 |

OTHER PUBLICATIONS

Yucel et al.:"Calculation of leakage and dynamic coefficients of stepped labyrinth gas seals," Applied Mathematics and Computation 152 (2004) 521-533.

* cited by examiner

ROTOR FOR A TURBOMACHINE, AND TURBOMACHINE HAVING SUCH A ROTOR

This claims the benefit of German Patent Application DE 10 2018 210 513.8, filed Jun. 27, 2018 which is hereby incorporated by reference herein.

The present invention relates to a rotor for a turbomachine, as well as to a turbomachine having such a rotor.

BACKGROUND

Rotors of turbomachines, for example, of stationary gas turbines and aircraft engines, are known from the related art in many variants. It is also known to equip a rotor arm or rotor base body of a rotor with one or a plurality of sealing fins. A sealing fin projects radially from the rotor base body relative to an axis of rotation of the rotor and, during operation of the rotor, cooperates with an associated sealing element, which is fixed relative to a casing of the turbomachine, in order to prevent undesired leakage. In addition, rotor sealing fins are usually configured with or on a base or platform. Such a base may be used for supporting masks during the coating of sealing fins. A large axial projection of the base is necessary to ensure that the rotor arm is not partially coated, which could lead to structural-mechanical disadvantages. For this purpose, such a base has a base portion disposed upstream of the sealing fin in the installation position of the rotor and a base portion disposed downstream of the sealing fin relative to an axial direction of the rotor.

However, it is not possible to arbitrarily increase the axial width of the base portions disposed to the left and right of the sealing fin, viewed in the axial direction, since axial and radial relative displacements between the sealing fin and the sealing element can occur during the operation of the associated turbomachine. If this circumstance is not sufficiently considered, an axial contact can occur between the base and the sealing element, for example, in the case of what is generally referred to as compressor surge. However, such a contact is unacceptable, since damages could occur. Often, however, axially narrower bases, where a contact between the base and the sealing element is reliably ruled out in all operating conditions of the associated turbomachine, have a supporting surface that is axially too small for masks used for the coating of sealing fins, for example. This can lead to unintentional coating of areas of the base or rotor arm as well, which must then be refinished and decoated or recoated.

SUMMARY OF THE INVENTION

It is an object of the present invention to provide a rotor which, on the one hand, will make possible a reliable coating masking and, on the other hand, also make it possible to fulfill the axial and radial clearance-gap requirements in all operating conditions of an associated turbomachine. It is a further object of the present invention to provide a turbomachine that will be able to fulfill the axial and radial clearance-gap requirements between the rotor thereof and an associated seal carrier in all operating conditions.

A first aspect of the present invention relates to a rotor for a turbomachine, in particular for an aircraft engine, having a rotor base body on which at least one sealing fin, which is disposed on a base, is provided for cooperating with an associated sealing element of the turbomachine; relative to an axial direction of the rotor, the base having a base portion disposed upstream of the sealing fin and a base portion disposed downstream thereof. In accordance with the present invention, the upstream base portion and the downstream base portion feature different radial distances to a radially outer sealing tip of the sealing fin. In other words, the base of the sealing fin is not symmetrically, but rather asymmetrically designed, by the base portions having different radial heights and thus different distances to the sealing tip of the sealing fin to the left or upstream of and to the right or downstream of the sealing fin. On the one hand, this makes possible a reliable coating masking and, on the other hand, fulfillment of the axial and radial clearance-gap requirements in all of the operating conditions of an associated turbomachine, since, by radially stepping the base, contact is not able to occur between one of the base portions and the associated sealing element of a seal carrier of the turbomachine. Thus, both the structural mechanical requirements (no contact in any of the operating points), as well as the manufacturing requirements (sufficient axial seating of a coating mask) are met. Moreover, the improved coatability results in a lower reworking rate, making it possible to realize corresponding reductions in time and cost. In addition, radially stepping the base makes it possible for one or a plurality of stepped sealing elements to be used, allowing for smaller axial designs, thereby enhancing the efficiency and the surge line of an associated turbomachine. It is generally noted that the terms "axial," "radial" and "circumferential" always refer to the machine axis or axis of rotation of the rotor in the installed state in the turbomachine, unless implicitly or explicitly indicated otherwise from the context. In the context of the present disclosure, "a/an" are generally to be read as indefinite articles and always also as "at least one," unless expressly stated otherwise. Conversely, "a" and "an" may also be understood to mean "only one."

An advantageous embodiment of the present invention provides that a ratio between the radial distance of the upstream base portion and the radial distance of the downstream base portion is between 0.25 and 4, it not being possible for the ratio to be 1. In other words, it is provided that A1:A2 is 0.25, 0.30, 0.35, 0.40, 0.45, 0.50, 0.55, 0.60, 0.65, 0.70, 0.75, 0.80, 0.85, 0.90, 0.95, 1.05, 1.10, 1.15, 1.20, 1.25, 1.30, 1.35, 1.40, 1.45, 1.50, 1.55, 1.60, 1.65, 1.70, 1.75, 1.80, 1.85, 1.90, 1.95, 2.00, 2.05, 2.10, 2.15, 2.20, 2.25, 2.30, 2.35, 2.40, 2.45, 2.50, 2.55, 2.60, 2.65, 2.70, 2.75, 2.80, 2.85, 2.90, 2.95, 3.00, 3.05, 3.10, 3.15, 3.20, 3.25, 3.30, 3.35, 3.40, 3.45, 3.50, 3.55, 3.60, 3.65, 3.70, 3.75, 3.80, 3.85, 3.90, 3.95, or 4.00, A1 denoting the radial distance or the radial height of the upstream base portion and A2 the radial distance or the radial height of the downstream base portion, and all intermediate values except for 1.0 (A1=A2) being regarded as included in the disclosure. This makes it possible for the specific requirements of the rotor and of the associated turbomachine thereof to be optimally considered.

In a further embodiment of the present invention, it turns out to be thereby advantageous that the rotor is in the form of a compressor rotor, and that the upstream base portion features a larger distance to the radially outer sealing tip of the sealing fin than the downstream base portion. It is alternatively provided that the rotor is in the form of a turbine rotor and that the upstream base portion has a smaller distance to the radially outer sealing tip of the sealing fin than the downstream base portion. This makes it possible to optimally allow for the different flow conditions in a compressor and in a turbine.

Further advantages are derived from the upstream base portion and the downstream base portion having different axial extents. In other words, not only may the radial height of the base portions to the left and right or upstream and downstream of the sealing fin differ, but the axial extents or widths thereof may also differ. In particular, a combination of different radial and axial extents has proven to be especially useful. The axial extent is thereby measured from an adjoining sealing fin wall to a respective edge of the relevant base portion. This permits especially short axial designs of the rotor, along with corresponding improvements in the efficiency and surge line of the associated turbomachine.

Another advantageous embodiment of the present invention provides that the rotor be in the form of a compressor rotor, and that the upstream base portion have a smaller axial extent than the downstream base portion or that the rotor be in the form of a turbine rotor, and that the upstream base portion have a larger axial extent than the downstream base portion. This makes it possible to optimally allow for the different flow conditions in a compressor and in a turbine.

Further advantages are derived from the sealing fin having a sealing tip that is asymmetric in cross section and/or that is provided with a coating. This makes it possible for the sealing action of the sealing fin to be optimally adapted to the particular application.

Another advantageous embodiment of the present invention provides that, axially, the rotor base body have at least two sealing fins, which are disposed one behind the other in the direction of flow and preferably have different radial distances to an axial axis of rotation of the rotor. The at least two sealing fins may hereby cooperate with radially stepped sealing elements, making possible a particularly effective sealing and a correspondingly improved leakage reduction.

A second aspect of the present invention relates to a turbomachine, in particular an aircraft engine, which, in accordance with the present invention, includes at least one rotor in accordance with the first aspect of the present invention, whose at least one sealing fin cooperates with at least one associated sealing element. The axial and radial clearance-gap requirements between the rotor and the associated sealing element may hereby be met in all operating conditions of the turbomachine. Various seals, such as honeycomb seals, may be used as the sealing element. Alternatively, a brush seal may also be provided as a sealing element. Other features and advantages thereof will become apparent from the descriptions of the first inventive aspect; advantageous embodiments of the first inventive aspect being considered to be advantageous embodiments of the second inventive aspect and vice versa.

An advantageous embodiment of the present invention provides that the at least one sealing element of the turbomachine be held by a seal carrier. This makes it possible for the at least one sealing element to be readily and reliably installed and, accordingly, easily replaced. The seal carrier may be formed as a one-piece ring or in multiple parts of a plurality of ring segments, which are then assembled to form a ring or annulus, similar to the guide vane ring. At the radially outer end thereof, the seal carrier may have a join region for placement thereof on a casing or a guide vane or a guide vane ring, while a region for placing the sealing element is provided at the radially inner end thereof.

Further advantages are derived from the at least one sealing element having an abradable seal, in particular a honeycomb seal. To reduce leakage of a flow-through medium, the abradable seal has the function of forming a sealing gap between the sealing tip of the at least one sealing fin and the static portion of the turbomachine. A honeycomb seal may optionally be directly deposited in the placement region of the seal carrier or on another machine part.

Another advantageous embodiment of the present invention provides that, axially, the rotor have at least two sealing fins, which are each located on a base and cooperate with respective sealing elements that are disposed relative to one another in a radially stepped configuration. Such a radially stepped sealing assembly makes possible an exceptional reduction of leakage and thus increases the efficiency and surge line of the turbomachine. In the manner described above, each base may thereby have an asymmetrical design. Alternatively, merely some or only one of the bases may have an asymmetrical design, as described above, while the other base(s) may have a symmetrical design.

Another advantageous embodiment of the present invention provides that the at least one sealing element be held on a casing of the turbomachine and/or on at least one guide vane, in particular on a guide vane ring. This allows for an especially effective sealing of a flow path of the turbomachine by an inner seal (inner air seal, IAS).

BRIEF DESCRIPTION OF THE DRAWINGS

Other features of the present invention will become apparent from the claims, the figures, and the detailed description. The features and feature combinations mentioned above in the description, as well as the features and feature combinations mentioned below in the detailed description and/or shown in isolation in the figures may each be used not only in the indicated combination, but also in other combinations, without departing from the scope of the present invention. Thus, embodiments of the present invention that are not explicitly shown and explained in the figures, but derive from and can be produced from the explained embodiments using separate feature combinations, are also considered to be included and disclosed herein. In addition, embodiments and combinations of features that, therefore, do not have all of the features of an originally formulated independent claim are also considered to be disclosed herein. Moreover, in particular by the above explanations, variants and feature combinations are also considered to have been disclosed herein that go beyond or deviate from the feature combinations described in the antecedent references to the claims. In the drawing.

DETAILED DESCRIPTION

Figure 1:
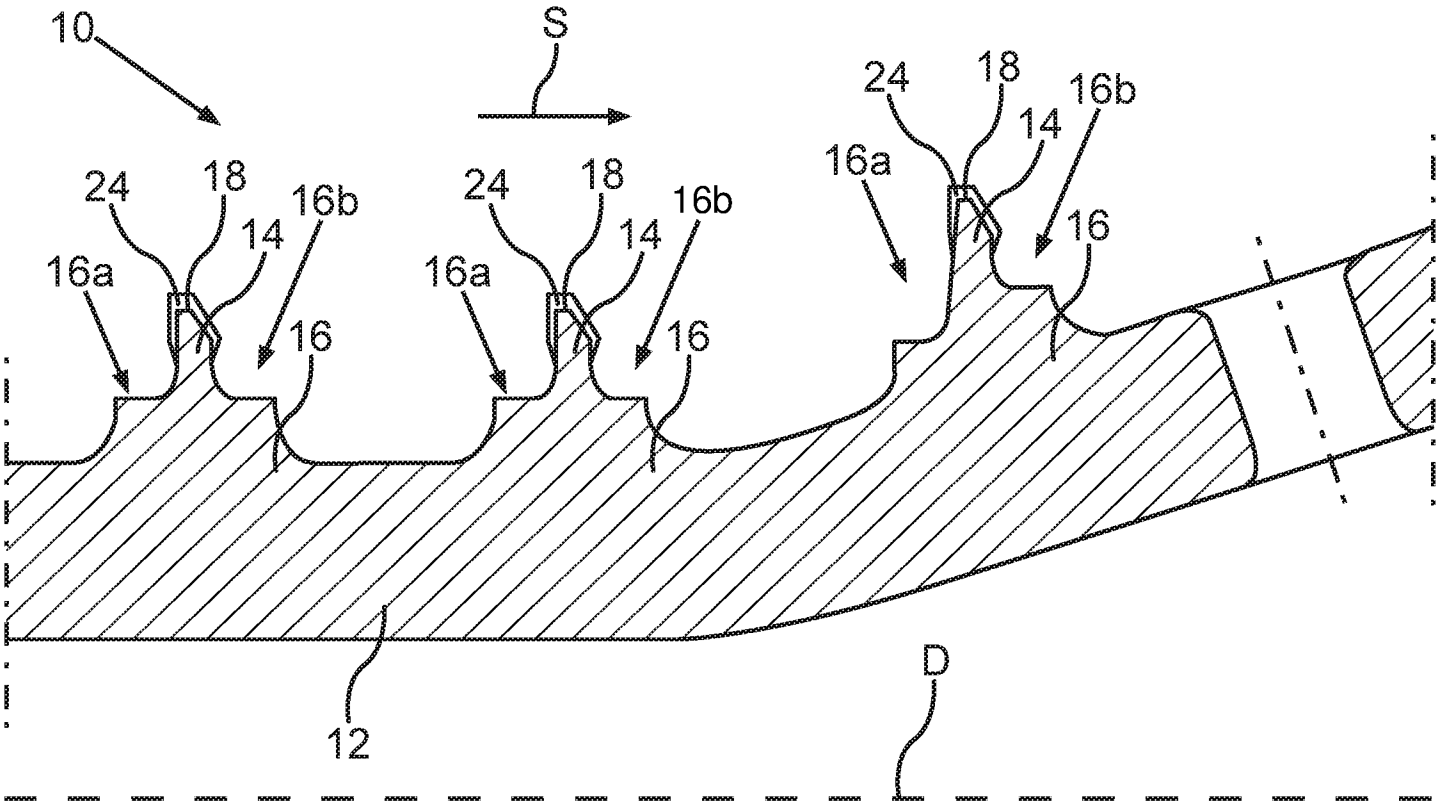
FIG. 1 is a schematic, axial sectional view of a rotor according to the present invention.

FIG. 1 shows a schematic, axial sectional view of an inventive rotor 10 of an aircraft engine. Rotor 10, which in the present case is in the form of a compressor rotor and, in the installed state, rotates about an axis of rotation D, includes a rotor base body 12, which bears three circumferentially extending sealing fins 14. Each sealing fin 14 is configured on a base 16. Base 16 may also be referred to as a platform. It is discernible that, relative to a direction of flow S of a working fluid of the associated flow direction, each base 16 has a base portion 16*a* disposed upstream of sealing fin 14 thereof and a base portion 16*b* disposed downstream of sealing fin 14 thereof. In the present exemplary embodiment, it is discernible that most downstream base 16 has an asymmetrical design, so that upstream base portion 16*a* thereof and downstream base portion 16*b* thereof have different radial distances to sealing tip 18 of respective sealing fin 14. However, an opposite design is also conceivable, for example, in the case of turbines. On the other hand, viewed in direction of flow S, first two bases 16 have a symmetrical design, so that upstream base portions 16*a* thereof and downstream base portions 16*b* thereof each have the same radial distance to respective sealing tip 18. In addition, base portions 16*a*, 16*b* of the two first bases 16 are also equally wide or, starting from sealing fin 14, have the same axial overhang. Alternatively, it may basically be provided, that, instead, one of the more upstream bases 16 has an asymmetric design with respect to the radial and possibly axial embodiment of base 16 thereof, or that a plurality of or all bases 16 have an asymmetric design with respect to the radial and possibly axial embodiment thereof. It is likewise generally possible for a greater or smaller number of bases 16 to be provided and a correspondingly greater or smaller number of sealing fins 14.

Figure 2:
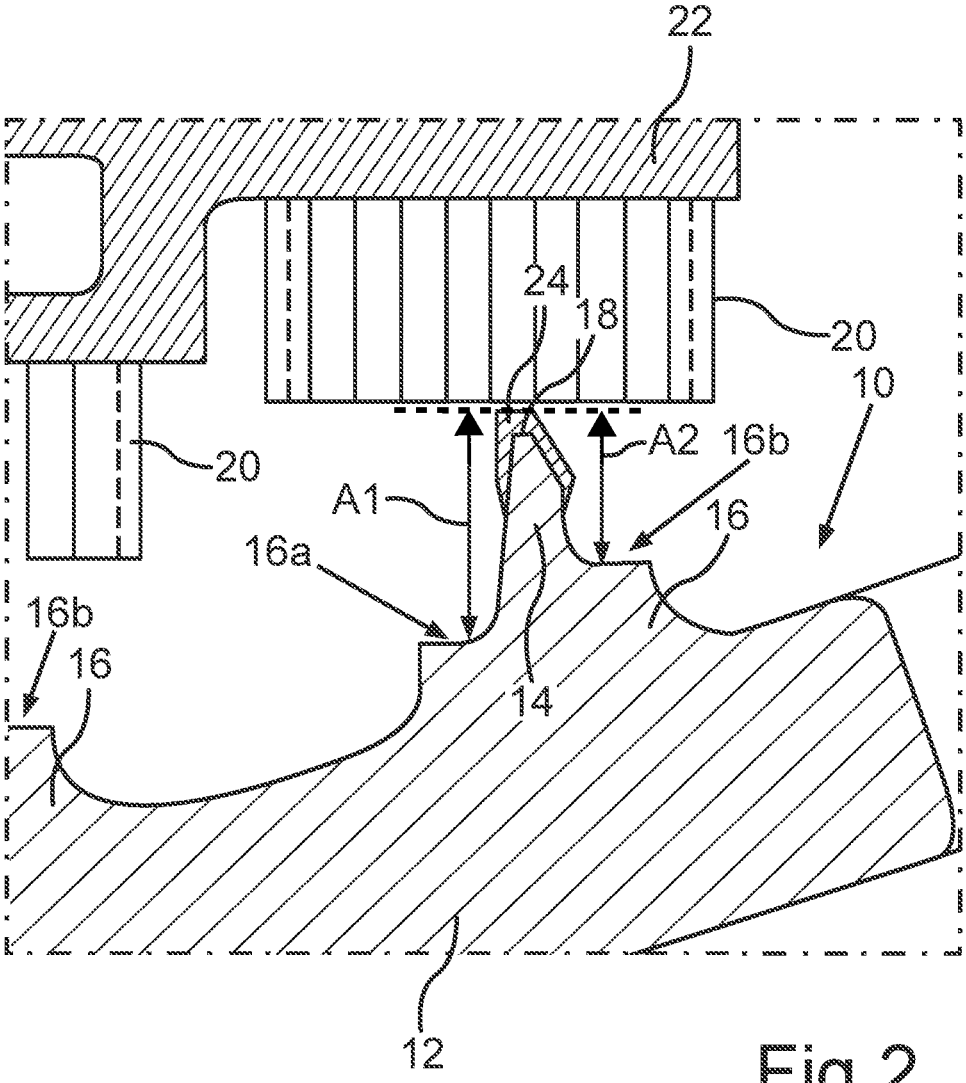
FIG. 2 is a schematic, axial sectional view of the rotor in the area of a sealing fin that cooperates with a sealing element of a turbomachine.

FIG. 2 shows a schematic, axial sectional view of rotor 10 in the installed state, in the area of most downstream sealing fin 14, which cooperates with an associated sealing element 20 of the turbomachine. In the present case, sealing element 20 is in the form of a honeycomb seal and held by a seal carrier 22 on a guide vane (not shown) of a compressor stage of the turbomachine. It is discernible that seal carrier 22 is designed as a stepped labyrinth seal of an inner seal (inner air seal, IAS), so that upstream sealing element 20 has a smaller radial distance to axis of rotation D of the rotor than downstream sealing element 20. It is also discernible that sealing tips 18 of all sealing fins 14 are asymmetrically formed in cross section and are provided with a coating 24, which may also be referred to as tip hardfacing. The ratio of left radial height A1 of upstream base portion 16*a* to right radial height A2 of downstream base portion 16*b* is approximately A1:A2=1.5 in the illustrated example; deviating ratios also being possible, in principle. The overhangs or the axial widths of base portions 16*a*, 16*b* may generally be the same or different. Because of the desired axially short design of a compressor stage and the radially stepped labyrinth seal for enhanced leakage reduction, the axial sealing fin positions are defined on rotor base body 12, and the overhang of individual bases 16 is limited. The axial overhangs of bases 16 are necessary to permit sufficient masking during the process of coating sealing tips 18. A too short width of base portions 16*a*, 16*b* may result in the lifting off of sealing lips, which are used for masking in coating or spraying processes. The possible consequence of such a lifting off is spraying right through, thereby undesirably coating the base faces or rotor base body 12. This is unacceptable for structural/mechanical reasons.

Figure 3:
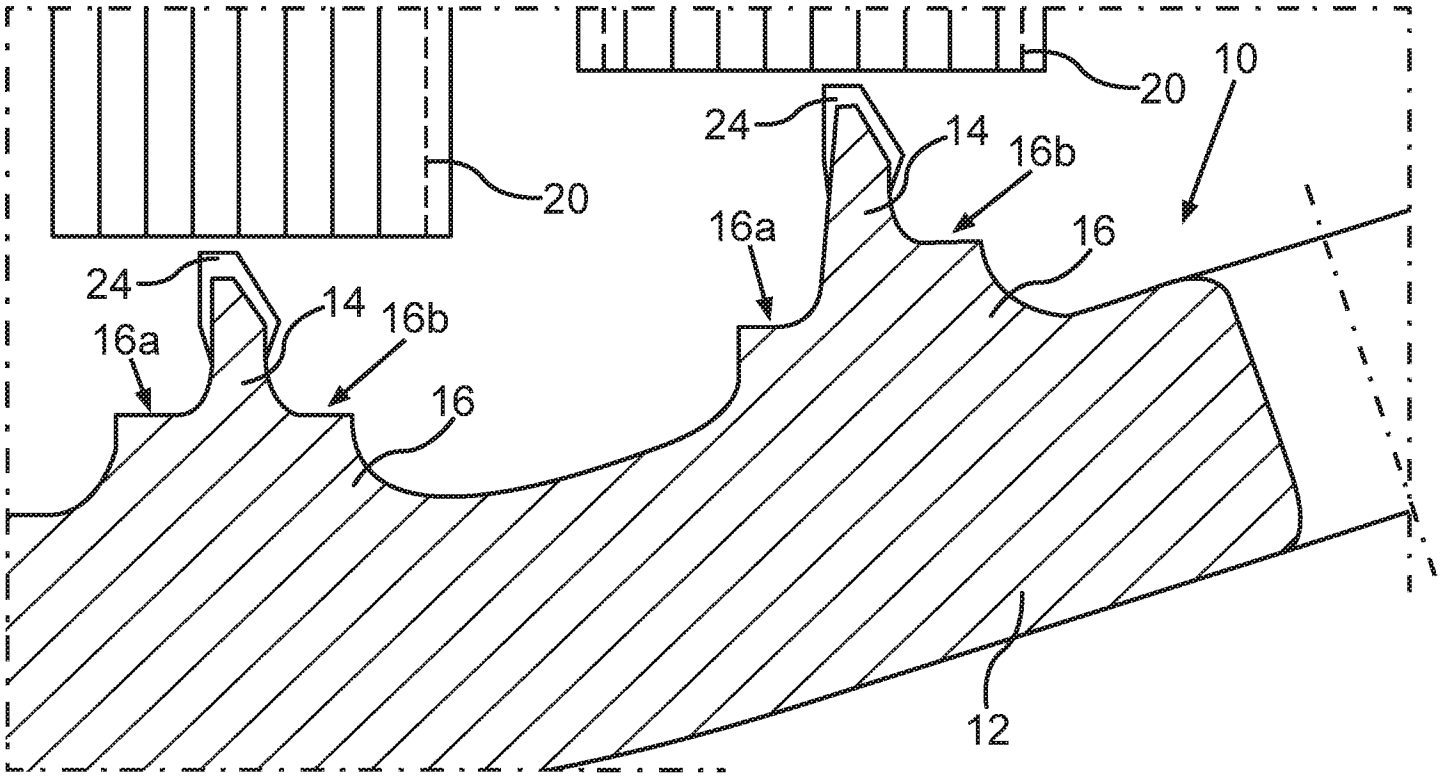
FIG. 3 is a schematic, axial sectional view of the rotor according to the present invention in the cold assembly condition.
Figure 4:
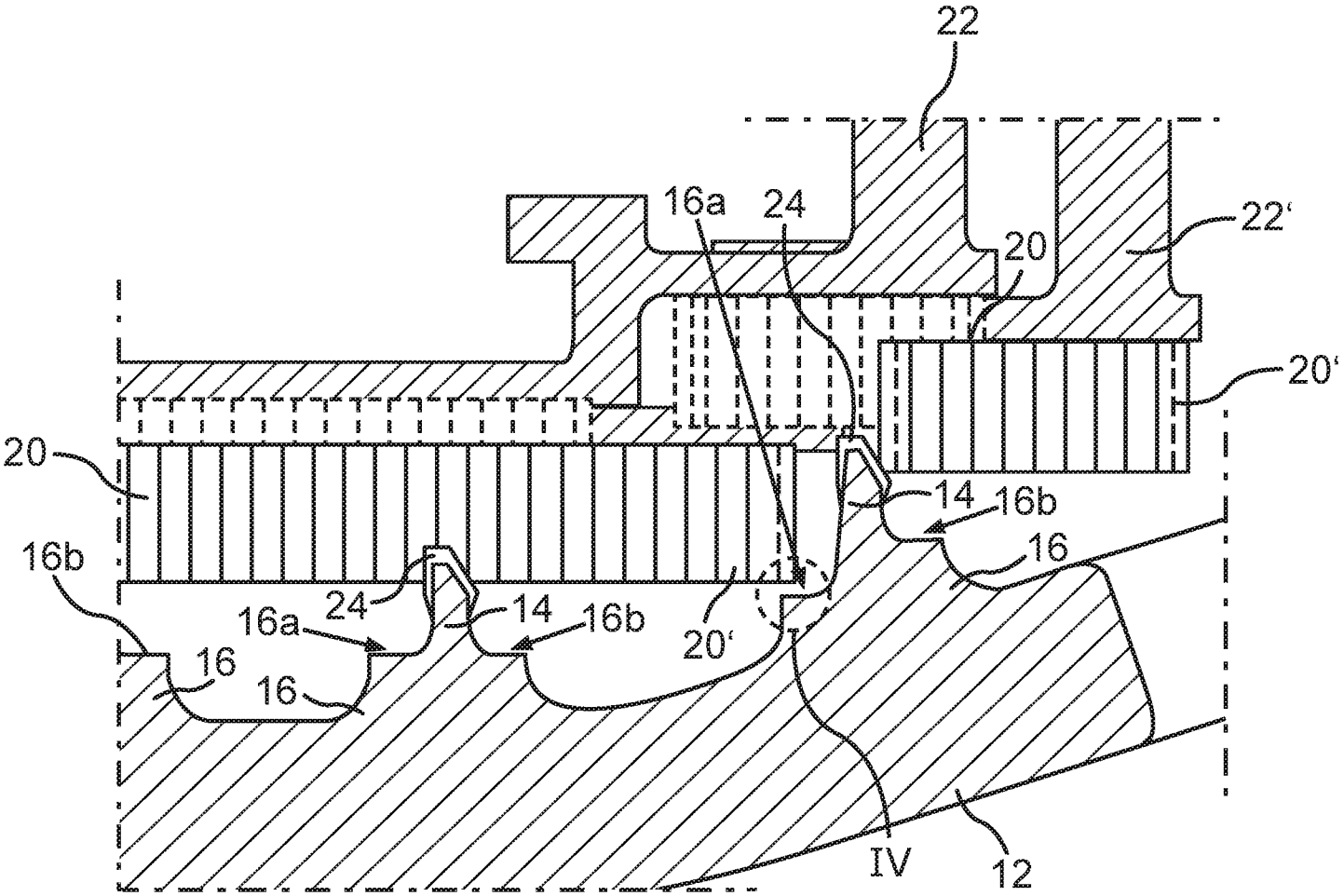
FIG. 4 is a schematic, axial sectional view of the rotor according to the present invention in two possible operating conditions of the associated turbomachine.

FIG. 3 shows a schematic, axial sectional view of rotor 10 according to the present invention in the cold assembly condition and is clarified in the following in conjunction with FIG. 4, which shows a schematic, axial sectional view of rotor 10 according to the present invention in two possible operating conditions of the associated turbomachine. The dotted-line position of sealing element 20 or of seal carrier 22 thereby corresponds to the cold assembly condition, while the solid-line position corresponds to the condition of what is generally referred to as compressor surge. The basic design of rotor 10 will become apparent from the preceding description. At certain operating points of the turbomachine, for example, in the presence of what is generally referred to as compressor surge, there is the risk of axial contact between the left or upstream base portion 16*a* of a base 16 and a sealing element 20 of inner-ring seal carrier 22. This contact is unacceptable, so the bases 16 must be designed to be correspondingly narrower. However, this, in turn, would reduce the supporting surface for a coating mask and entail the risk of unacceptable coatings. Generally, an alternative axial displacement of the sealing fin position is also not possible due to the stepping or the necessary axial overhangs of sealing elements 20. Both of these problems may be overcome with the aid of the inventive radial stepping of at least one base 16. As is especially discernible in region IV in FIG. 4, even a considerable relative displacement of sealing elements 20 relative to rotor 10 does not lead to a collision between sealing element 20 and the left or upstream base portion 16*a* of rear base 16. The design in accordance with the present invention of reducing the radial height of base 16 on one side makes it thereby nevertheless possible to maintain the necessary axial width of both base sides 16*a*, 16*b*, without any radial or axial contact occurring between base 16 and honeycomb 20. The individually requisite radial distance between sealing tip 18 and base portions 16*a*, 16*b* is implemented in a clearance-gap design for all operating points. It makes possible an enhanced producibility of sealing fin coating 24 along with a lower reworking rate, thereby leading to a reduction of the manufacturing costs. Radially stepping at least one base 16 facilitates or allows for the use of stepped sealing elements 20 in the case of small compressor dimensions, since a smaller axial design is possible. This leads to an improvement in the efficiency and surge line of the turbomachine that is equipped accordingly.

LIST OF REFERENCE NUMERALS

10 rotor
12 rotor base body
14 sealing fin
16 base
16*a* base portion
16*b* base portion
18 sealing tip
20 sealing element
22 seal carrier
24 coating
D axis of rotation
S flow direction
A1 distance
A2 distance

What is claimed is:

1. A rotor for a turbomachine, the rotor comprising:

a rotor base body having a sealing fin disposed on a base, the rotor base body having a radially inner surface and a radially outer surface, the sealing fin for cooperating with a seal of the turbomachine; and, relative to an axial direction of the rotor, the base protruding from the radially outer surface and having a base portion upstream of the sealing fin, and a base portion downstream of the sealing fin, the upstream and downstream base portions defining support surfaces extending parallel to the axial direction for supporting masks during coating of the sealing fin, wherein the sealing fin has the coating;

wherein the upstream base portion and the downstream base portion have different radial distances to a radially outer sealing tip of the sealing fin and wherein the upstream base portion and the downstream base portion have different axial extents.

2. The rotor as recited in claim 1 wherein a ratio between the radial distance of the upstream base portion and the radial distance of the downstream base portion is between 0.25 and 4, the ratio not being 1.

3. The rotor as recited in claim 1 wherein the rotor is a compressor rotor, and the upstream base portion has a larger distance to the radially outer sealing tip of the sealing fin than the downstream base portion.

4. The rotor as recited in claim 1 wherein the rotor is a turbine rotor, and the upstream base portion has a smaller distance to the radially outer sealing tip of the sealing fin than the downstream base portion.

5. The rotor as recited in claim 1 wherein the rotor is a compressor rotor, and the upstream base portion has a smaller axial extent than the downstream base portion.

6. The rotor as recited in claim 1 wherein the rotor is a turbine rotor, and the upstream base portion has a larger axial extent than the downstream base portion.

7. The rotor as recited in claim 1 wherein the sealing fin has a sealing tip asymmetric in cross section.

8. The rotor as recited in claim 1 wherein, axially, the rotor base body has at least two sealing fins disposed one behind the other in a direction of flow.

9. The rotor as recited in claim 8 wherein the at least two sealing fins have different radial distances to an axial axis of rotation of the rotor.

10. A turbomachine comprising the rotor as recited in claim 1 and the seal, the sealing fin cooperating with the seal.

11. The turbomachine as recited in claim 10 wherein the seal is held by a seal carrier.

12. The turbomachine as recited in claim 11 wherein the seal includes an abradable seal.

13. The turbomachine as recited in claim 12 wherein the abradable seal is a honeycomb seal.

14. The turbomachine as recited in claim 10 further comprising a second sealing fin disposed on a second base for cooperating with a second seal and spaced axially from the sealing fin, the seal disposed relative to the second seal in a radially stepped configuration.

15. The turbomachine as recited in claim 10 wherein the seal is held on a casing of the turbomachine or on at least one guide vane.

16. The turbomachine as recited in claim 10 wherein the seal is held in a guide vane ring.

17. An aircraft engine comprising the turbomachine as recited in claim 10.

18. The rotor as recited in claim 1 wherein the radially outer surface has a constant radius section and a radially expanding section, the base being located on the radially expanding section.

* * * * *